US005411063A

United States Patent [19]

Hacker et al.

[11] Patent Number: 5,411,063

[45] Date of Patent: May 2, 1995

[54] SEAM-WEAVING MACHINE WITH FRINGE CATCHER

[75] Inventors: Hans-Eugen Hacker, Reutlingen; Edgar Hofstetter, Hohenstein; Eckhard Kaminski, Pfullingen, all of Germany

[73] Assignee: Novatech GmbH, Reutlingen, Germany

[21] Appl. No.: 193,419

[22] Filed: Feb. 7, 1994

[30] Foreign Application Priority Data

Feb. 8, 1993 [DE] Germany ..... 9301722 U

[51] Int. Cl.[6] ..... D03C 3/20; D03C 13/00

[52] U.S. Cl. ..... 139/383 AA; 28/141

[58] Field of Search ..... 139/383 AA; 28/141

[56] References Cited

U.S. PATENT DOCUMENTS 4,410,015 10/1983 Koller et al. .
4,581,794 4/1986 Oldroyd et al. .
4,736,499 4/1988 Kopcke .
5,003,675 4/1991 Esser et al. .
5,027,483 7/1991 Anderson ..... 139/383 AA X
5,117,542 6/1992 Krenkel et al. ..... 139/383 AA X
5,183,081 2/1993 Kuster et al. ..... 139/383 AA X

FOREIGN PATENT DOCUMENTS 8122449 1/1983 Germany .
3507450 9/1986 Germany .

*Primary Examiner*—Andrew M. Falik
*Attorney, Agent, or Firm*—Sughrue, Mion, Zinn, Macpeak & Seas

[57] ABSTRACT

A seam-weaving machine for making a fabric endless by a woven seam is provided with a fringe catcher adjacent the edge zone of the woven seam. The fringe catcher, after a shed change, is moved forward beyond the fell by a drive device and upon return of the fringe catcher, draws an upwardly protruding fringe thread away to the rear above the already formed part of the woven seam.

2 Claims, 3 Drawing Sheets

SEAM-WEAVING MACHINE WITH FRINGE CATCHER

BACKGROUND OF THE INVENTION

The invention relates to a seam-weaving machine for making a fabric endless, which weaves a woven seam out of fringes formed at the opposed fabric ends and from weft threads removed from the fabric. Fringes, aligning with each other in each case, of the fabric ends are guided upwards and/or downwards out of the woven seam at splice points which are distributed over the width of the woven seam. The invention further relates to a fringe catcher for such a seam-weaving machine, which fringe catcher has an arm, movable by a drive device, with a hook at the front end, which hook grasps the fringe ends protruding from the woven seam and lays them aside in such a way that they do not interfere as the weaving process continues.

Industrial plastics fabrics for uses in which a very regular surface structure of the fabric is required, in particular flat-woven plastics paper forming fabrics, are made endless by a woven seam. To produce a woven seam, warp threads are exposed to a length of about 20 cm at the fabric ends which are to be joined to each other, the weft threads being removed from this zone. The woven seam, in which the original weave binding is exactly reproduced, is then formed from these warp thread fringes and the weft threads removed from the fabric ends. For this purpose, an auxiliary weaving shed or seam-weaving shed is spread out from the removed weft threads, in which shed the removed weft threads function as auxiliary warp threads. The warp thread fringes are inserted into this auxiliary weaving shed as auxiliary weft threads alternately from the two fabric ends. The warp thread fringes are not inserted over the full width of the seam-weaving shed, but are guided out of the seam-weaving shed at a so-called splice point. The warp thread fringe, aligning with it, of the other fabric end is likewise inserted into the seam-weaving shed only up to this splice point. The inserted lengths of the warp thread fringes, aligning with each other, of the two fabric ends thus supplement each other to the full width of the woven seam. The splice points are distributed over the woven seam in a pattern, so that the tensile strength of the woven seam is as high as possible.

DE-U-81 22 449 discloses a piercer finger which, in the case of a seam-weaving machine which has a heald frame shedding device, reaches or pierces through the auxiliary warp threads of the upper shed and draws out, upwardly from the shed, the auxiliary weft thread initially inserted over the full width of the woven seam. At its front end, the piercer finger is fitted with a clamping device for this purpose. The piercer finger is swivellable and displaceable parallel to the auxiliary warp threads and also movable over the width of the woven seam.

EP-A-43 441 discloses a seam-weaving machine with a Jacquard shedding device. A piercer finger is not necessary in this case, as the tying-in of the auxiliary weft threads into only a part of the width of the woven seam is achieved by virtue of the fact that the shed is stretched over only a corresponding part. In this case, it depends on the insertion position of the draw-through gripper whether the ends of the warp thread fringes protrude upwardly or downwardly from the woven seam. In general, the warp thread fringes protrude on the running side of the paper-forming fabric, so that they cause no marking in the paper.

U.S. Pat. No. 4,581,794, issued on Apr. 15, 1986 to Malcolm Oldroyd, et al. likewise discloses a seam-weaving machine operating with a Jacquard shedding device. This seam-weaving machine has two extractors attached laterally directly outside the woven seam, which are intended to take over the warp thread fringe drawn through the seam-weaving shed by a draw-through gripper and draw it out upwardly. Problems arise, however, as the draw-through gripper moves below the plane of the fabric, while the extractor is arranged above the plane of the fabric and outside the woven seam width, with the result that the extractor would have to grasp through the fabric end.

Paper-forming fabrics often consist of two fabric layers which are bound to each other by special binding threads. When such multi-layered fabrics are being made endless, it is not desirable to guide all the warp thread fringes out to one side, generally the running side, since the ends of the warp thread fringes of the paper-side fabric layer would then, deviating from the binding pattern, have to be guided through the running-side fabric layer. This will result in a fault in the binding pattern and, because of the higher thread volume, a reduction in water permeability, which leads in turn to a marking in the paper.

SUMMARY OF THE INVENTION

The object of the present invention is therefore to provide a seam-weaving machine in which the fringe ends can be drawn onto the upper side of the fabric or, generally, the fringe ends can also be drawn onto the side of the fabric opposite the draw-through gripper.

According to the present invention, this object is achieved in that there is arranged, in the edge zone of the woven seam, a fringe catcher having a drive mechanism which, after the shed change, moves the fringe catcher forward beyond the fell and back, with the result that the fringe catcher draws an upwardly protruding fringe away to the rear and above the already-formed part of the woven seam.

The foregoing and other objects, features and advantages of the invention will be apparent from the following more particular description of a preferred embodiment of the invention as illustrated in the accompanying drawings.

DETAILED DESCRIPTION OF THE INVENTION

Figure 1:
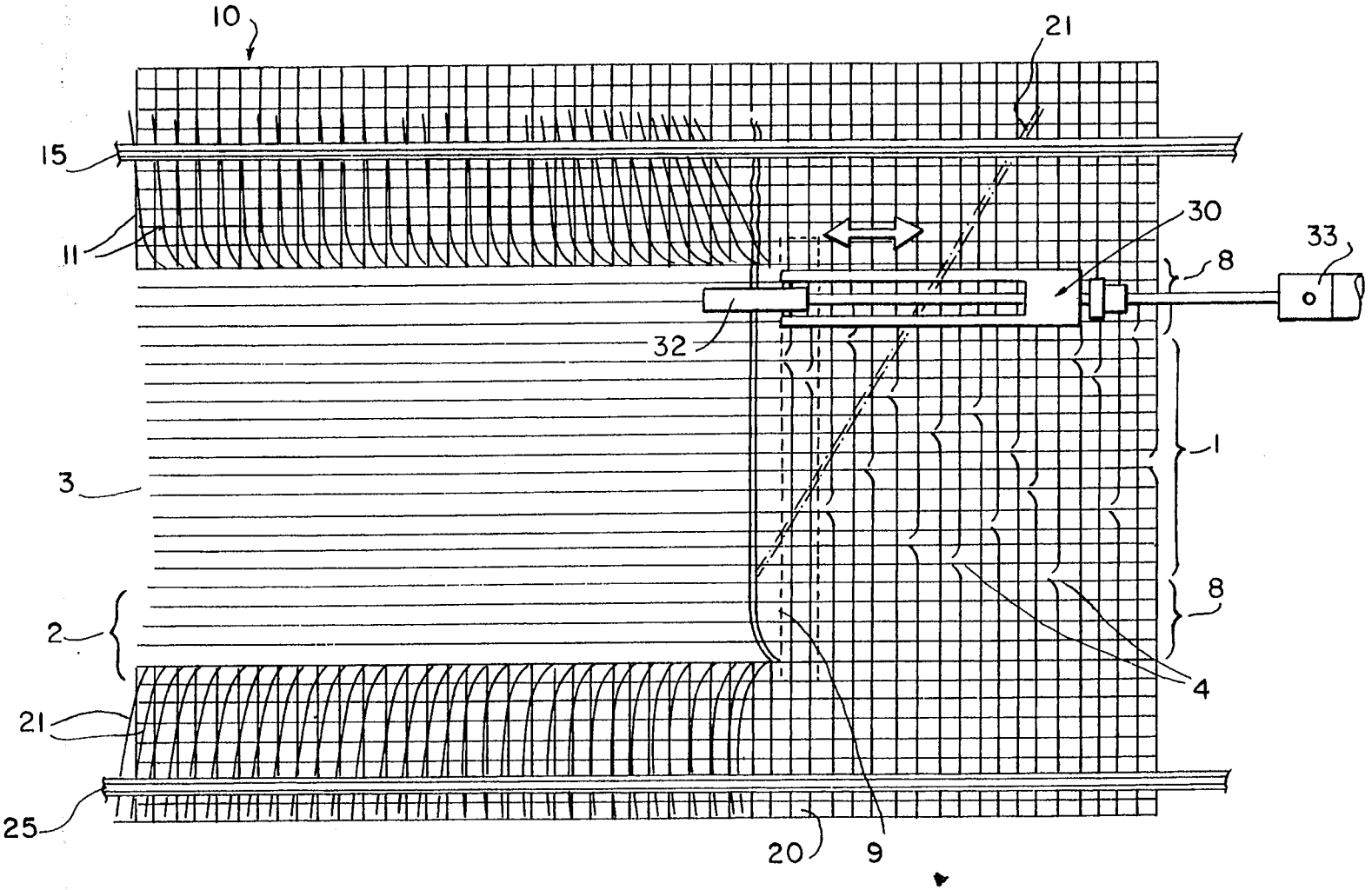
FIG. 1 is a greatly simplified representation of a partially formed woven seam as seen from above.

The fringes of every fabric end are held in a so-called magazine ribbon, in the order pre-set by the weave binding. The fringes are removed singly from the magazine ribbon by a separator, such as disclosed in DE-U-89 03 454, and brought downwards laterally next to the seam-weaving shed by a transfer gripper. From the opposite side of the seam-weaving shed, the draw-through gripper (DE-U-92 15 498) extends through the seam-weaving shed, grips the fringe and entrains it upon its return movement, as a result of which the fringe is inserted into the seam-weaving shed. In the process, the draw-through gripper exerts a stress on the fringe, with the result that the latter lies taut in the seam-weaving shed. A sley (DE-U-92 11 353) beats up the fringe against the fell. As a result of its crimp, the fringe will be inserted in form-locking manner according to the weave binding between the auxiliary warp threads. The shedding device, which is a Jacquard machine, forms only a partial shed, i.e. the upper shed does not extend over the maximum width of the woven seam, with the result that the beaten-in fringe runs from the splice point over all the auxiliary warp threads, but dips downwardly again at the opposite end of the woven seam and finally protrudes downwardly. The function of the fringe catcher according to the invention is to draw the fringe end upwards so that it no longer passes through downwardly at the edge of the woven seam. This is necessary only with a multi-layer fabric since the warp thread fringes which participate in the formation of the fabric layer which lies above in the seam-weaving machine are to be drawn out upwardly.

The fringe catcher is preferably arranged at the outermost edge within the width of the woven seam. Some 3 mm to 5 mm of the edge zone of the woven seam remain free from splice points. On each side of the woven seam, the fringe catcher is preferably arranged which moves in the approximately 3 mm to 5 mm wide edge zone and grasps the fringes in this edge zone.

The fringe catchers can be fixedly positioned or can be movable over the width of the woven seam, i.e. parallel to the warp fringes or auxiliary weft threads in the woven seam. It is also possible to provide only a single fringe catcher which is movable over the width of the woven seam and is shifted to and from between the two outermost edge positions of the woven seam.

The hook is preferably wide enough at the front end of the fringe catcher so that it spans a few auxiliary warp threads and can rest on these with little force. The back of the hook rises forwardly with the result that, during its forward movement, the fringe catcher slides away over the fringe which is to be gripped. It is also possible to raise the fringe catcher during its forward movement by means of a control curve and thereby lift it beyond the fringe which is to be gripped. Upon its return movement, the hook of the fringe catcher must rest on the auxiliary warp threads or the already formed part of the woven seam.

In order that the fringe catcher can grasp the fringe concerned after the beating-up of the reed and the shed change through a rectilinear movement, the upper shed lies approximately in the plane of the fabric and the lower shed points downwardly at the shed-opening angle. During the formation of the partial shed, those auxiliary warp threads which do not participate in the formation of the partial shed are located in the lower shed, with the result that the inserted fringe runs over all these auxiliary warp threads. After the beating-up of the reed, the shed change takes place, whereby the auxiliary warp threads in the opposite edge zone of the woven seam inevitably participate in the succeeding partial shed, as there is no splice point in this edge zone. During the formation of the succeeding partial shed, the fringe which has just been inserted is in every case forced upwardly in this edge zone through a part of the auxiliary warp threads. The hook of the fringe catcher slides over the fringe during the forward movement, entrains it during the return movement and draws out its downward-pointing end upwardly.

The particular advantage of this procedure is that the fringe catcher does not take over the inserted fringe from the draw-through gripper and as a result does not have to rely on a precise interaction with the draw-through gripper. The cycle time is reduced by virtue of the fact that the fringe catcher grasps the fringe only after the shed change, with the result that its activity overlaps chronologically with the drawing through of the next fringe.

The two ends 10, 20 of a fabric are to be connected to each other by a woven seam 1. To this end, fringes 11,21 are formed at the fabric ends 10, 20 by removing weft threads, which fringes are kept at their ends by magazine ribbons 15 and 25 (FIGS. 1 and 2) in the order or sequence pre-set by the weaving process. The fringes 11, 21 are thus the ends of the warp threads of the fabric. They are inserted as so-called auxiliary weft threads into a shed 2 which is stretched between the ends 10, 20 of the fabric which are spaced from each other by about 5 to 15 cm. The woven seam is formed from weft threads which were removed from the fabric e.g. at the ends 10, 20 and function as auxiliary warp threads 3 during the production of the woven seam and provide the seam-weaving shed.

As is customary when producing a woven seam, the seam-weaving shed 2 is formed by a Jacquard machine. Every fringe 11 of one fabric end 10 corresponds to or aligns with a fringe 21 of the other fabric end 20. The fringes 11, 21 are not tied into the whole width of the woven seam 1, but the fringes 11, 21 which align with each other meet at a splice point 4 within the width of the woven seam 1 and emerge upwardly or downwardly from the woven seam 1 at this splice point 4. This partial tying-in of the fringes 11, 21 is achieved in a known manner by virtue of the fact that the Jacquard machine forms the seam-weaving shed 2 in such a way that it does not extend over the whole width of the woven seam 1, but only over the zone into which the thread of the fringe 11 or 21 is to be woven in. The thread of the fringe 21 or 11 aligning with it is or will be incorporated through the formation of a corresponding seam-weaving shed 2, extending from the other end 20 or 10, which supplements the seam-weaving shed 2 of the aligning first-mentioned thread of the fringe 11, 21 to the full width of the woven seam 1.

The fringes 11, 21 are inserted by removing an individual thread of one of the fringes 11, 21 in a known manner by a separator such as disclosed in DE-U-89 03 454 from the magazine ribbon 15, 25 and isolating them. A transfer gripper (not shown) takes over the isolated thread of the fringe from the separator, brings it downwardly to the level of the seam-weaving shed 2 and there transfers it to a draw-through gripper (DE-U-92 15 498) extending through the seam-weaving shed 2, which gripper, during its return movement, draws the fringe thread through the seam-weaving shed 2. To enable satisfactory monitoring, in particular of the operation of the separator, the magazine ribbons 15, 25 and the separator are arranged above the plane of the fabric ends 10, 20 and the woven seam 1. The draw-through gripper must then act on the opposite side, i.e. below this plane, since otherwise it would interfere with the fringes 11, 21 extending upwardly from the fabric ends 10, 20 to the magazine ribbons. The consequence of this is that shedding must take place in such a way that the ends of the fringes 11, 21 are guided out downwardly at the splice points 4. This is not a problem with single-layer fabrics, as the fabric can be inserted into the seam-weaving machine in such a way that the side of the fabric from which the ends of the fringes 11, 21 are to emerge faces downwardly. This is normally the running side of a paper forming fabric. In the case of multi-layer fabrics, the result of this would be that the fringes of the warp threads of the fabric layer lying above in the seam-weaving machine also have to be guided out downwardly. However, this leads to a fault in the weave binding and thus to a change in drainage capacity and finally to markings in the paper.

Figure 2:
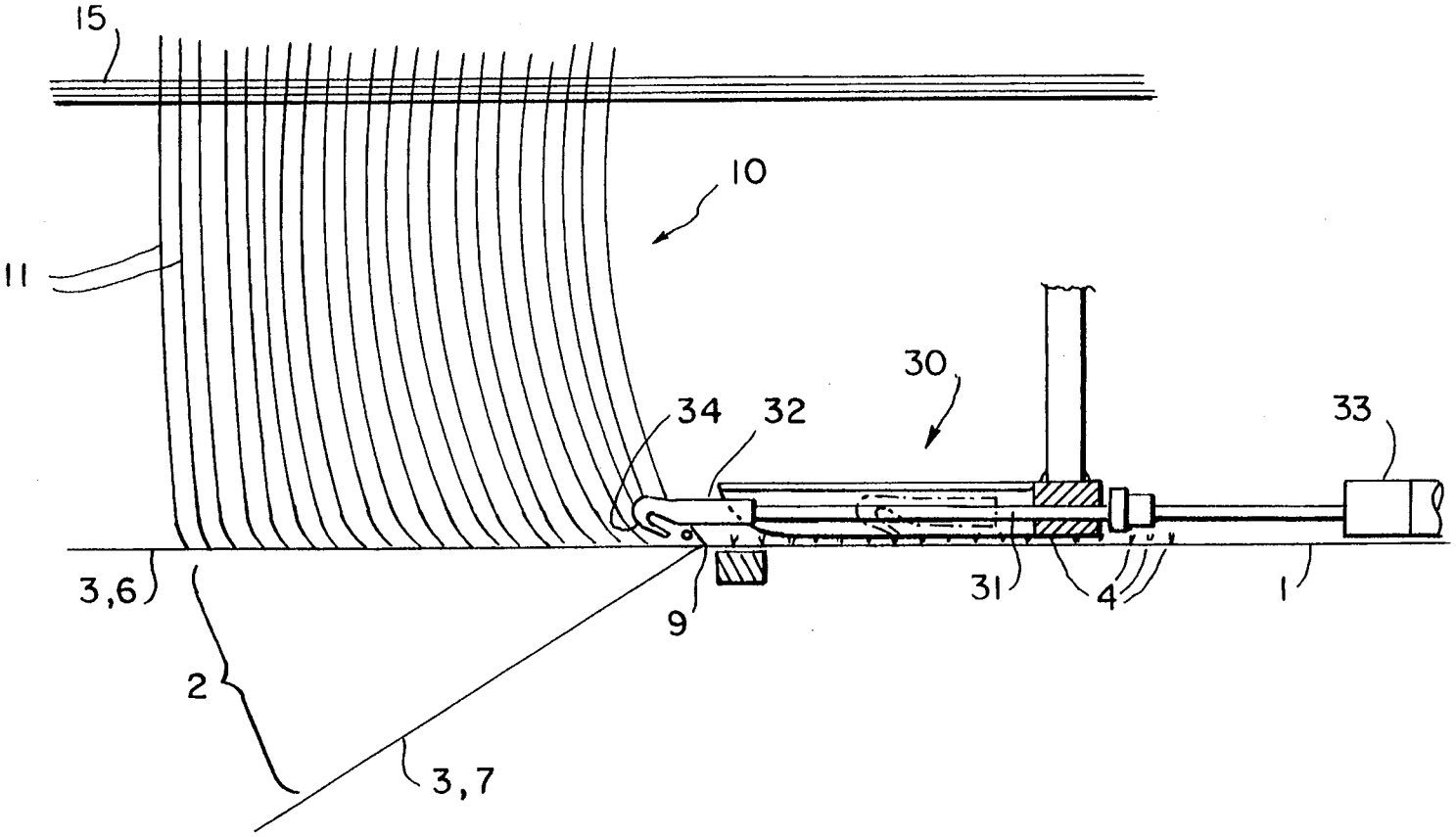
FIG. 2 is a similar view to FIG. 1, but from the side.

As shown in FIGS. 1 and 2, this problem is solved by virtue of the fact that the seam-weaving shed 2 is formed such that the upper shed 6 lies in the plane of the fabric ends 10, 20 and of the woven seam 1, while the lower shed 7 points-downwardly. As mentioned, the seam-weaving shed 2 is always formed only from the fabric end 10 or 20 from which the fringe thread is to be taken and extends as far as the splice point 4. All the auxiliary warp threads 3 outside this seam-weaving shed 2 are located in the lower shed so that the fringe thread incorporated by means of the draw-through gripper (not shown) runs outside the partial seam-weaving shed 2 over the auxiliary warp threads 3. After the beating-up of the reed (not shown), and the shed change, some of these auxiliary warp threads 3 inevitably enter the upper shed 6 and the inserted fringe thread rests on the upper shed 6. There the inserted fringe thread is grasped by a fringe catcher 30, drawn backwards away from the fell 9 over the already formed zone of the woven seam 1 and may be pushed under a spring clamp or securing strip (not shown), In order that this fringe thread will not interfere as the weaving process continues.

Figure 3:
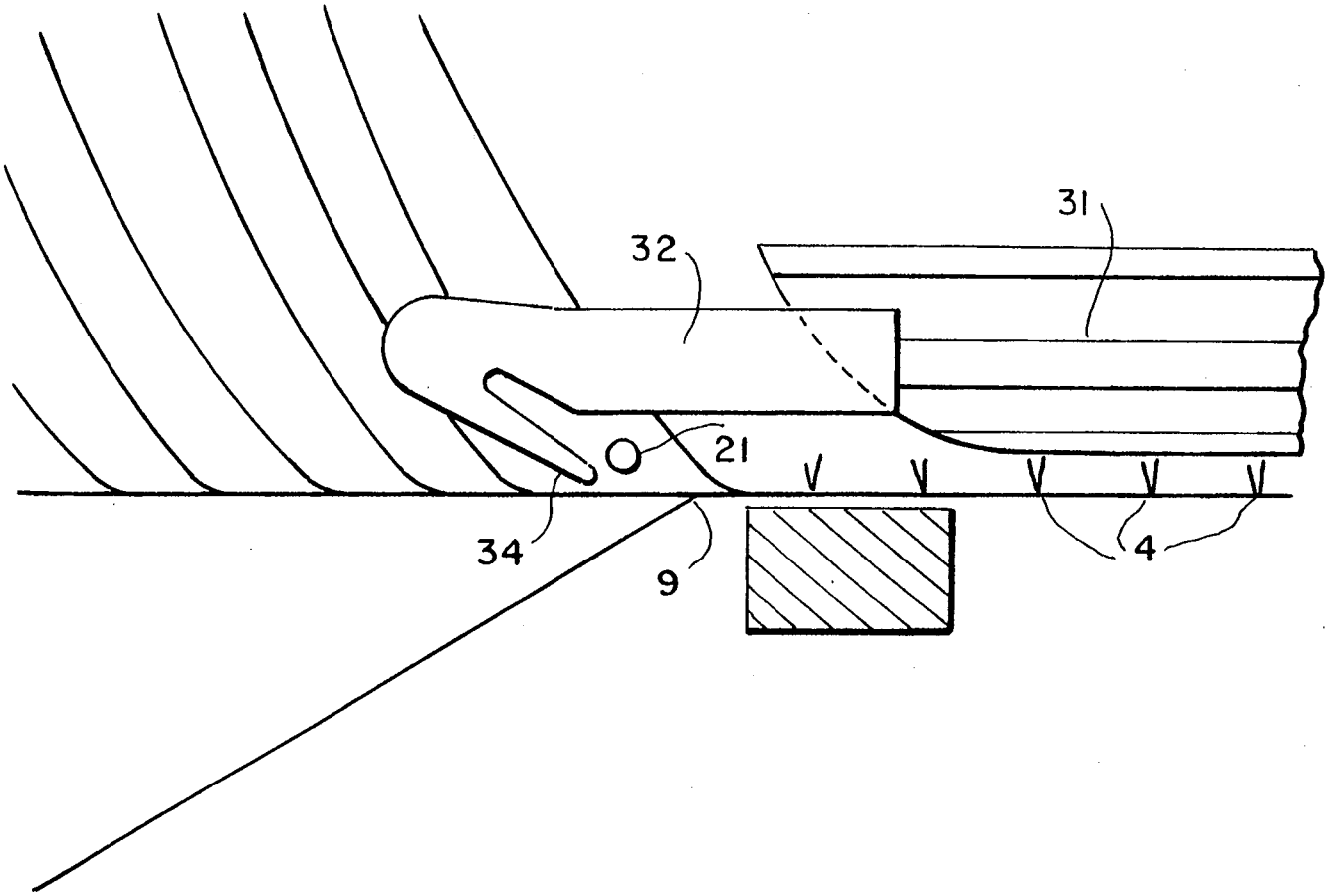
FIG. 3 is a view of the hook of the fringe catcher in an enlarged section from FIG. 2.

The fringe catcher 30 has a projecting rod 31 at whose front end a hook 32 is provided. The hook 32 opens to the rear like a barb as shown in FIGS. 2 and 3. The fringe catcher 30 is movable forward and back parallel to the auxiliary warp threads 3 by a drive device 33, generally a pneumatic cylinder. The hook 32 is rounded on its underside in such a way that it can rest with small force on the woven seam 1 and the auxiliary warp threads 3 located in the upper shed 6, without damaging them. The rearwardly-pointing tip 34 of the hook 32 has a sufficient width to rest on three or more auxiliary warp threads 3 and is similar in design to a landing skid. During the forward movement of the fringe catcher 30, the tip 34 travels over the fringe thread which is to be grasped and entrains it during the return movement of the fringe catcher 30. The jaw width of the hook 32 is so dimensioned that the fringe thread can slide with some friction through the hook 32, taking into consideration the crimp or corrugation of the fringe 11, 21 which is produced by the thermosetting of the fabric.

The fringe catcher 30 is arranged in such a way that it can grasp all the fringe threads guided out upwardly, regardless of where the splice point 4 is located. To this end, a fringe catcher 30 is positioned at each outermost edge of the woven seam and at the same time the outermost edge zone 8 of the woven seam 1, in which the fringe catcher 30 moves, is kept free of splice points 4. In general, a width of 3 to 5 mm suffices for this edge zone 8. In FIG. 1, for reasons of simplicity, only one fringe catcher 30 is represented. As a rule, however, two fixedly positioned fringe catchers 30 are used, their position being modifiable according to the width of the woven seam to be woven in an individual case.

While the invention has been particularly shown and described with reference to preferred embodiments thereof, it will be understood by those in the art that the foregoing and other changes in form and details may be made therein without departing from the spirit and scope of the invention.

What is claimed is:

1. In a seam-weaving machine for making a fabric endless by weaving a woven seam out of fringes formed at opposed fabric ends which constitute auxiliary weft threads and from weft threads removed from the fabric which constitute auxiliary warp threads in which a seam-weaving shed is formed, said machine including a separator for separating a single auxiliary weft thread from a fringe, a shedding device for forming a shed in said auxiliary warp threads, a gripper device for taking a single auxiliary weft thread from the separator and inserting said auxiliary weft thread through said shed, and a sley for beating the inserted auxiliary weft thread against a fell of an already formed part of a woven seam, whereby auxiliary weft threads disposed in alignment with each other are guided upwardly out of the woven seam at splice points which are distributed over the width of the woven seam, the improvement comprising a fringe catcher overlying said already formed part of the woven seam and a drive device for driving the fringe catcher disposed adjacent an edge zone of the woven seam perpendicular to the fell for moving the fringe catcher parallel to said auxiliary warp threads forwardly beyond the fell and backwardly while resting on the already formed part of the woven seam for engaging and drawing an upwardly protruding fringe thread away from the fell.

2. In a seam-weaving machine as set forth in claim 1, wherein said fringe catcher is comprised of an elongated rod having a hook on a forward end thereof with a rear end thereof connected to said drive means.

* * * * *